US009834882B2

(12) United States Patent
Patil

(10) Patent No.: US 9,834,882 B2
(45) Date of Patent: Dec. 5, 2017

(54) DEVICE AND METHOD FOR HEAT PUMP BASED CLOTHES DRYER

(75) Inventor: Mahendra Madhukar Patil, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1149 days.

(21) Appl. No.: 13/177,815

(22) Filed: Jul. 7, 2011

(65) Prior Publication Data

US 2013/0008049 A1 Jan. 10, 2013

(51) Int. Cl.

| | |
|---|---|
| ***D06F 58/24*** | (2006.01) |
| ***D06F 58/22*** | (2006.01) |
| ***D06F 58/28*** | (2006.01) |
| ***F26B 21/08*** | (2006.01) |
| ***D06F 58/20*** | (2006.01) |
| *F26B 11/04* | (2006.01) |
| *D06F 58/02* | (2006.01) |

(52) U.S. Cl.

CPC ..... *D06F 58/206* (2013.01); *D06F 58/24* (2013.01); *F26B 21/086* (2013.01); *D06F 58/02* (2013.01); *D06F 58/22* (2013.01); *D06F 58/28* (2013.01); *D06F 2058/287* (2013.01); *D06F 2058/2854* (2013.01); *F26B 11/04* (2013.01)

(58) Field of Classification Search

CPC ..... D06F 58/24; D06F 58/22; D06F 58/206; F26B 21/086

USPC .. 34/469, 470, 477, 480, 82, 86, 74, 75, 77, 34/79

See application file for complete search history.

(56) References Cited

U.S. PATENT DOCUMENTS 2,570,808 A * 10/1951 Hermes ..... 34/77
2,959,044 A * 11/1960 Stone ..... 34/79
4,603,489 A 8/1986 Goldberg
(Continued)

FOREIGN PATENT DOCUMENTS

DE 4409607 C2 * 3/2002 ..... D06F 58/206
EP 0 467 188 B1 4/2001
(Continued)

OTHER PUBLICATIONS

"Adjacent". In The American Heritage Dictionary of the English Language. Boston: Houghton Mifflin, 2011. http://search.credoreference.com/content/entry/hmdictenglang/adjacent/0 (accessed Dec. 11, 2014.).*

*Primary Examiner* — Jianying Atkisson
*Assistant Examiner* — Tavia Sullens
(74) *Attorney, Agent, or Firm* — Dority & Manning, P.A.

(57) ABSTRACT

The present disclosure relates to a heat pump based dryer or a combination washer and dryer device comprising a housing receiving a drum for containing associated articles to be dried by air that flows along a pathway between an outlet and an inlet of the housing. A fluid is provided in the pathway to at least partially remove moisture from the air. A heat pump includes a heat source located at least partially within the pathway and a heat sink being operatively adapted to the heat source to circulate a refrigerant therein. An enclosure at least partially containing the heat sink is arranged to accept the fluid from the pathway to exchange heat with the heat sink and return the fluid to the pathway. Fluid may be provided to the pathway by a spray nozzle adjacent the outlet or by an evaporative media downstream of a lint separator.

17 Claims, 14 Drawing Sheets

(56) References Cited

U.S. PATENT DOCUMENTS

| | | | | |
|---|---|---|---|---|
| 4,621,438 | A | 11/1986 | Lanciaux | |
| 6,094,835 | A | 8/2000 | Cromer | |
| 7,055,262 | B2 * | 6/2006 | Goldberg | D06F 58/206 34/108 |
| 7,325,333 | B2 * | 2/2008 | Tadano | D06F 58/206 34/604 |
| 2005/0204755 | A1 | 9/2005 | Nishiwaki et al. | |
| 2005/0217133 | A1 | 10/2005 | Yakumaru et al. | |
| 2010/0155326 | A1 * | 6/2010 | Grunert | 34/82 |

FOREIGN PATENT DOCUMENTS

| | | | |
|---|---|---|---|
| EP | 1 154 065 | B1 | 12/2003 |
| EP | 1 108 811 | B1 | 2/2004 |
| JP | 2003-075065 | A | 3/2003 |
| JP | 2003-172559 | A | 6/2003 |
| JP | 2004-089413 | A | 3/2004 |
| JP | 2004-089415 | A | 3/2004 |
| JP | 2004-116899 | A | 4/2004 |
| JP | 2004-135752 | A | 5/2004 |
| JP | 2004-329755 | A | 11/2004 |
| JP | 2005-027768 | A | 3/2005 |
| JP | 2008-048810 | A | 6/2008 |
| JP | 2008-048811 | A | 6/2008 |
| WO | WO 2004/076948 | A1 | 9/2004 |
| WO | WO 2005/032322 | A2 | 4/2005 |

* cited by examiner

DEVICE AND METHOD FOR HEAT PUMP BASED CLOTHES DRYER

BACKGROUND OF THE DISCLOSURE

The present disclosure relates to a heat pump clothes dryer device and method wherein a circulating fluid exchanges heat with an evaporator. A cool circulating fluid is introduced to a warm humid airflow to condense and collect moisture therein to be returned to the evaporator thereby using the enthalpy of the circulating fluid, evaporator, and dryer airflow.

Conventional clothes dryers generally comprise an open loop air flow passage that introduces hot dry ambient air to a moist load and exhausts the resulting hot humid air to the atmosphere. These dryers have an electric heater to heat the dry ambient air to desired temperatures during a drying process. Additionally, it is known to introduce a continuous flow of cold water to the warm humid air to cause dehumidification of the air prior to being vented to the atmosphere. These dryers often have a very limited drying capacity and also have longer drying cycle times. These dryers also consume large amounts of energy and water during the drying process.

Solutions have been developed to reduce consumption of excess energy and water. One known solution is to circulate the moisture laden air within a closed loop system having a condenser or other heat exchanger. This condenser dryer system uses the condenser to cool the warm humid air and condense water vapor from the warm humid air into either a drain pipe or a collection tank. This air is then reheated at a heat supply and reintroduced to the load again. The heat exchanger typically uses an external ambient air as its coolant. The heat produced by the heat exchanger in this dryer will be transferred to the immediate enclosed surroundings instead of being ducted to an external atmosphere thereby increasing the room temperature. In some designs, cold water is used in the heat exchanger, eliminating this heating, but also requiring increased water usage.

In terms of energy use, condenser dryers typically require less system-wide energy use than conventional dryers. Energy savings result from the associated HVAC system not having to heat or cool additional air to replace that exhausted by the conventional dryer. Typically, this savings is sufficient to offset the increase in power draw, longer drying times, and ambient cooling requirements associated with condensation dryers.

Because the heat exchange process simply cools the internal air using ambient air or cold water, it will not dry the air in the internal loop to as low a level of humidity as the fresh, ambient air. As a consequence of the increased humidity of the air used to dry the load, this type of dryer requires relatively more time than the conventional dryer. Condenser dryers are a particularly attractive option where long, intricate ducting would be required to vent a conventional dryer.

Whereas condensation dryers use a passive heat exchanger cooled by ambient air, heat pump dryers use an internal heat pump having an additional refrigeration cycle. Generally known heat pump dryers help to further reduce energy consumption from the previously mentioned dryer systems. Here, warm humid air from a moist load is passed through a heat pump where the evaporator coil cools the air and condenses the water vapor into either a drain pipe or a collection tank and the hot side reheats the air. Heat pump dryers typically utilize a fin and tube type of evaporator coil within a closed loop air passageway. As with condensation dryers, the known heat exchanger will not dry the internal air to as low a level of humidity as the ambient air.

With respect to ambient air, the higher humidity of the air used to dry the clothes has the effect of increasing drying times. However, because heat pump dryers conserve much of the heat of the air they use, the already-hot air can be cycled more quickly, possibly leading to shorter drying times than conventional dryers. In this way, not only does the dryer avoid the need for external duct routing, but this arrangement also conserves much of the heat within the dryer instead of exhausting the heat into the surroundings. Heat pump dryers can therefore use less than half the energy required by either condensation or traditional dryers.

This arrangement is more efficient than conventional dryers but is susceptible to associated problems of lint accumulation on the evaporator and at times even on the condenser causing lower heat transfer efficiency and difficulty in balancing the sealed system performance during the drying process. Additionally, the continuous change in a cooling load and a dehumidification load further causes inefficiencies with system balance. For at least the foregoing reasons, there remains a need for a more concise, efficient, and cost effective device and method for reducing energy consumption in a heat pump dryer by more efficiently using the enthalpy of a circulating fluid, an evaporator, and air within the device.

SUMMARY OF THE DISCLOSURE

The present disclosure relates to a heat pump based dryer comprising a housing receiving a drum for containing associated articles to be dried by air that flows along a pathway between an outlet and an inlet of the housing. A fluid is provided in the pathway to partially remove moisture from the air and a heat pump including a heat source or condenser is located at least partially within the pathway. A heat sink or evaporator is operatively adapted to the heat source to circulate a refrigerant therein and an enclosure at least partially containing the heat sink and is arranged to accept the fluid from the pathway to exchange heat with the heat sink and return the fluid to the pathway.

A pump may be provided to transport fluid between the enclosure and the pathway. Additionally, a collector may be operatively associated with the pathway to receive the fluid and the moisture removed from the air. The fluid and moisture removed from the air is then provided to a tank. The tank may be provided with a drain valve if too much fluid is provided to the tank.

In one embodiment, at least a portion of the fluid is provided within the pathway at a position adjacent to the outlet. Here the collector may include a generally cyclone shaped body adapted to receive the air and having a lint separator to separate lint from the air and to remove the moisture from the air to the tank. At least a portion of the fluid is then provided to the enclosure to exchange heat with the heat sink.

In another embodiment, the collector may include an evaporative exchange media having a plurality of perforations by which the fluid is provided on the evaporative exchange media to create a wet surface. The air within the pathway passes over the wet surface and separates the moisture from the air thereby collecting the fluid and moisture and providing it to the tank. A lint collector is provided upstream of the collector in this embodiment.

In each embodiment, the heat pump may further include an expansion valve and a compressor positioned in communication between the condenser and the evaporator whereby the expansion valve and compressor further manipulate the pressure and temperature of the refrigerant.

A controller may be provided for controlling the heat pump based dryer and may be associated with at least one sensor for measuring at least one variable output. The controller is configured to receive and process data representative of sensor readings measured by the sensor for selectively maintaining at least a temperature of the fluid to be below a dew point of the air at the outlet of the housing. The controller may also be configured to manipulate the outputs of a fan, the compressor, a pump, the drain valve or an auxiliary heater provided upstream of the condenser. More particularly, the sensors are adapted to identify the temperature of the fluid as it leaves the enclosure, the temperature of the air adjacent to the outlet and the relative humidity of the air adjacent to the outlet. These sensor locations help to identify the dew point of the air and temperature of the fluid for efficient use of the enthalpy of the air within the dryer.

In yet another embodiment, a method of drying articles with a heat pump based dryer is provided where the dryer includes a housing receiving a drum for containing associated articles to be dried and a condenser operatively associated with an evaporator for manipulating the temperature and pressure of a refrigerant, the evaporator including a return fluid heat exchanger. The method includes the steps of passing air of a predetermined temperature through the housing to dry the articles, adding a fluid to the air in a pathway, the fluid having a predetermined temperature below a dew point of the air for dehumidifying the air within the pathway and creating condensation and a cooler, dryer airflow, collecting the fluid and condensation within the pathway, providing at least a portion of the fluid and condensation to the evaporator return fluid heat exchanger, heating the air with the condenser within the pathway to a predetermined temperature and returning the fluid to the pathway and the air to the housing.

Additionally, the step of adding a fluid to the air may further include using an evaporative exchange media having a plurality of perforations whereby the fluid is first added to the evaporative exchange media creating a wet surface. The air then passes over the wet surface and at least partially separates the fluid and condensation from the air.

DETAILED DESCRIPTION OF THE PREFERRED EMBODIMENTS

Figure 1:
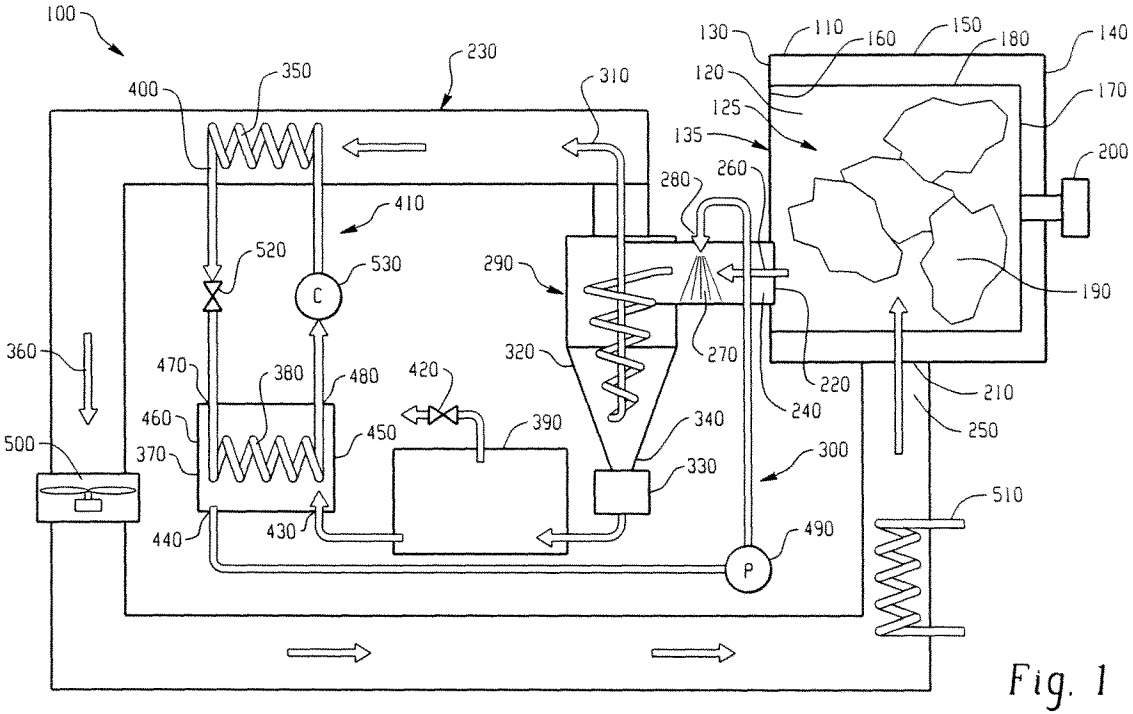
FIG. 1 is a schematic view of a first embodiment of a heat pump dryer.

The present disclosure is generally directed to a heat pump dryer and a method of drying articles with a heat pump based dryer that provide a more concise, efficient, and cost effective device and method for reducing energy consumption in a heat pump dryer by using the enthalpy of a circulating fluid, an evaporator, and air within the device. This dryer and method are directed at a home appliance for drying moist clothing articles. This dryer may include an individual dryer appliance or may comprise a combination washer/dryer appliance having a washing cycle prior to a drying cycle.

FIGS. 1-5 depict a schematic layout of various embodiments of the heat pump dryer 100. The dryer 100 preferably comprises a housing 110 for receiving and enclosing a drum 120 having a cavity 125 therein. The housing 110 has a first end 130, a second end 140 and at least one side 150 extending generally perpendicularly between the first and second ends 130, 140. The first end 130 includes an access door 135 to allow selective access to the cavity 125 of the drum 120 and to maintain a secure and pressurized environment within the housing 110 when closed. The drum 120 has a generally cylindrical shaped body having a rim 160, a base 170 and a generally continuous sidewall 180 extending in a general perpendicular direction between the rim 160 and the base 170. The rim 160 focus an opening to provide access through the door to the cavity 125 for loading and unloading associated articles (e.g., laundry or clothing) 190 to be dried.

The base 170 of the drum 120 is operatively attached and preferably axially aligned to a motor 200. The motor 200 is schematically depicted as being located outside the housing 110 however the motor 200 is often located within the housing 110. When operated, the motor 200 rotates the drum 120 and the articles 190 within the cavity 125.

An inlet 210 and an outlet 220 are provided for airflow communication with the articles 190 within the cavity 125 of the drum 120. A pathway 230 extends between the outlet 220 and the inlet 210 as depicted in FIGS. 1-5. The pathway 230 generally comprises a ducted passage of a predetermined cross sectional area made of a suitable material such as foil, aluminum, plastic, metal or any combination therein to allow a pressurized airflow communication between the inlet 210, outlet 220, cavity 125 and other components of the heat pump dryer 100 as will be described more fully herein. Although the pathway 230 is schematically depicted as being located externally from the housing 110, one skilled in the art will also recognize that the pathway 230 or portions thereof may be located in the housing, and all other schematically depicted components within the housing, thereby allowing ducted airflow communication within the dryer 100. The internal cross sectional area of the pathway 230 may be shaped in any preferred manner such as a rectangle, a square, a circle, or an oval, so long as the cross sectional are is capable of allowing consistent flow of air as a function of a size of a load to be dried and an energy output of each component within the dryer 100.

A first end 240 of the pathway 230 is attached to the outlet 220 while a second end 250 of the pathway is attached to the inlet 210. Hot humid air 260 exits the outlet 220 and enters the pathway 230 through the first end 240. A drying cycle of one embodiment of the heat pump dryer is depicted by FIG. 1. Here, a fluid 270 is introduced to the pathway 230 at a location adjacent to the outlet 220. The fluid 270 generally comprises water of a reduced temperature as it enters the pathway 230. However the fluid 270 but may also comprise a mixture of other materials generally known in the art that acts to prevent bacteria and mold growth or the corrosion of internal components. The fluid 270 may also comprise solvents or detergents that have evaporated from the associated articles 190 to be dried. The fluid 270 passes thru a spray nozzle 280 attached to the pathway 230 to allow the fluid 270 to comprehensively interact with the hot humid air 260. The fluid 270 provided at the spray nozzle is at a decreased temperature that is below a dew point temperature of the hot humid air 260. The interactions of the fluid 270 with the hot humid air 260 causes heat and mass transfer or a phase change whereby moisture is extracted by condensation from the hot humid air 260 by which a reduction in temperature of the hot humid air 260 is also achieved. The fluid 270 and condensation is then received in a collector 290 and combined to be circulated through one embodiment of a circulating fluid cycle 300 of the device 100 which will be described more fully herein.

Figure 2:
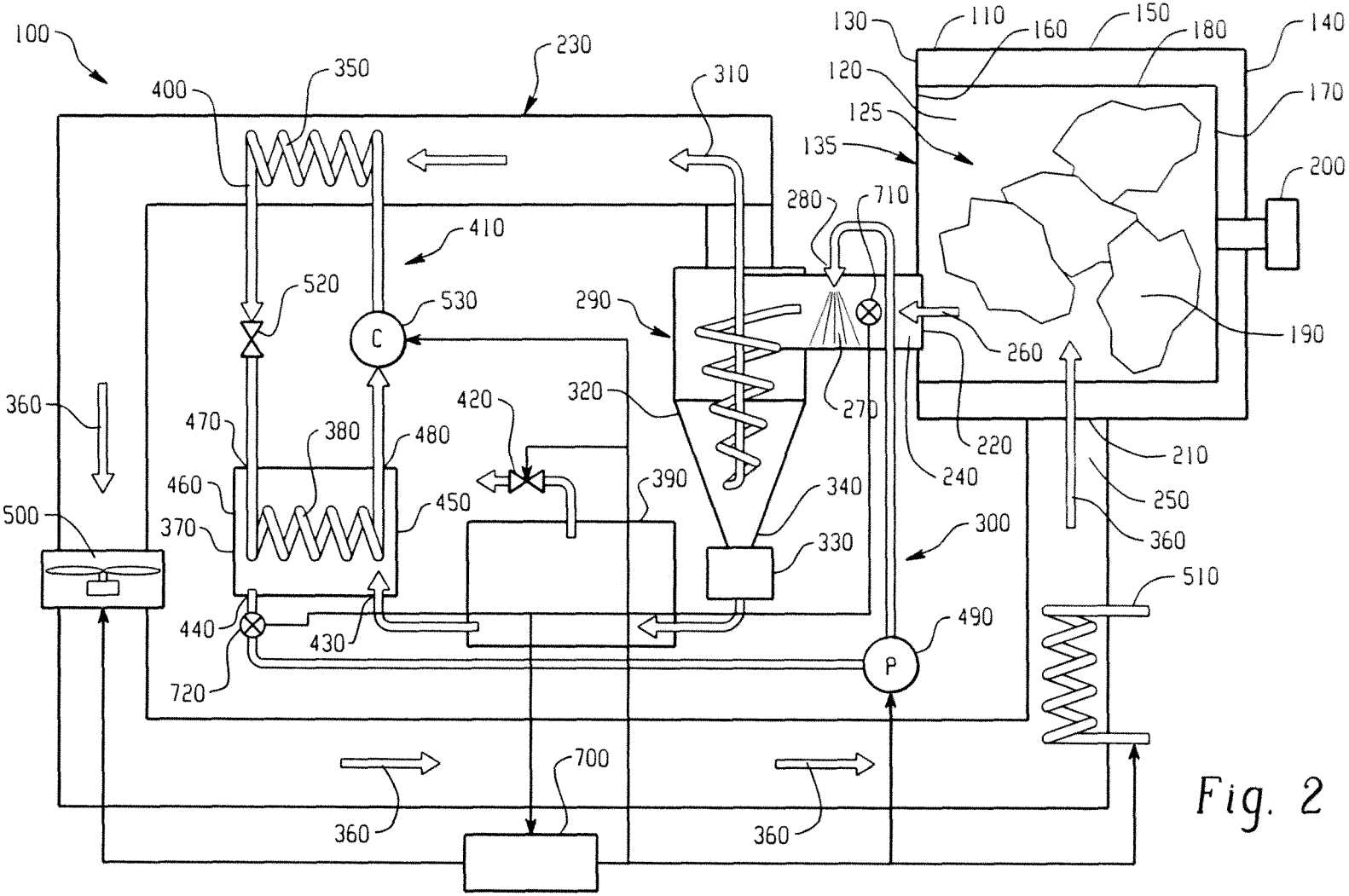
FIG. 2 is a schematic view of the first embodiment of the heat pump dryer with the addition of a controller.

The fluid 270 is introduced to the pathway 230 by the spray nozzle 280 having a temperature below the dew point temperature of the hot humid air 260 by which a heat and mass transfer interaction causes the hot humid air 260 to become cool dry air 310. In one embodiment as depicted by FIGS. 1 and 2, the cool dry air 310 passes through a collector 290 that collects lint, airborne particles and the remaining fluid 270 to be circulated through the circulating fluid cycle 300. Notably, the fluid 270 and condensate from the hot humid air 260 are combined and have an increased temperature as they are received by the collector 290. The collector 290 may comprise a generally cyclone shaped body 320 that is operatively positioned and shaped to receive the cool dry air 310 downstream from the spray nozzle 280 while also collecting the remaining lint and fluid from the cool dry air 310. The lint and fluid 270 is received at a lint separator 330 preferably located at a base 340 of the cyclone body 320 which allows an associated user to access the lint separator 330 to remove unwanted lint and particles from the collector 290. However, the collector 290 is not limited to having a generally cyclone shaped body 320 and may also comprise other arrangements that are shaped to receive fluid 270 and unwanted lint from the cool dry air 310 such as a conventional mesh filter arrangement.

Figure 3:
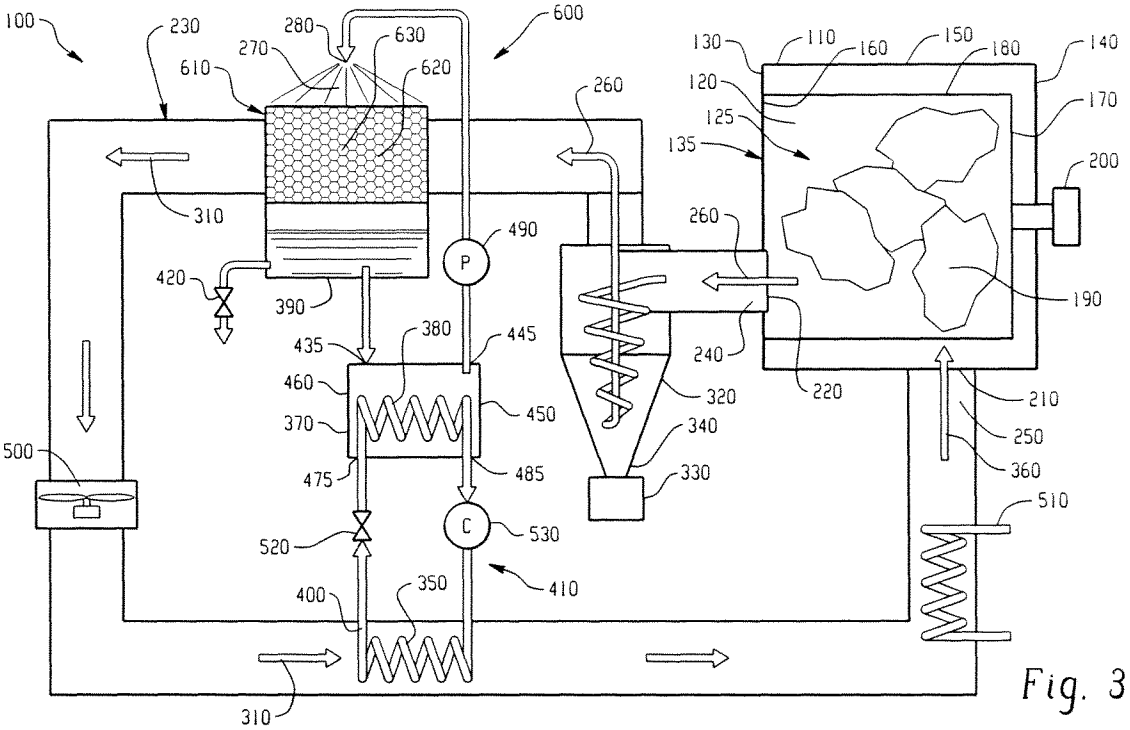
FIG. 3 is a schematic view of a second embodiment of the heat pump dryer.
Figure 4:
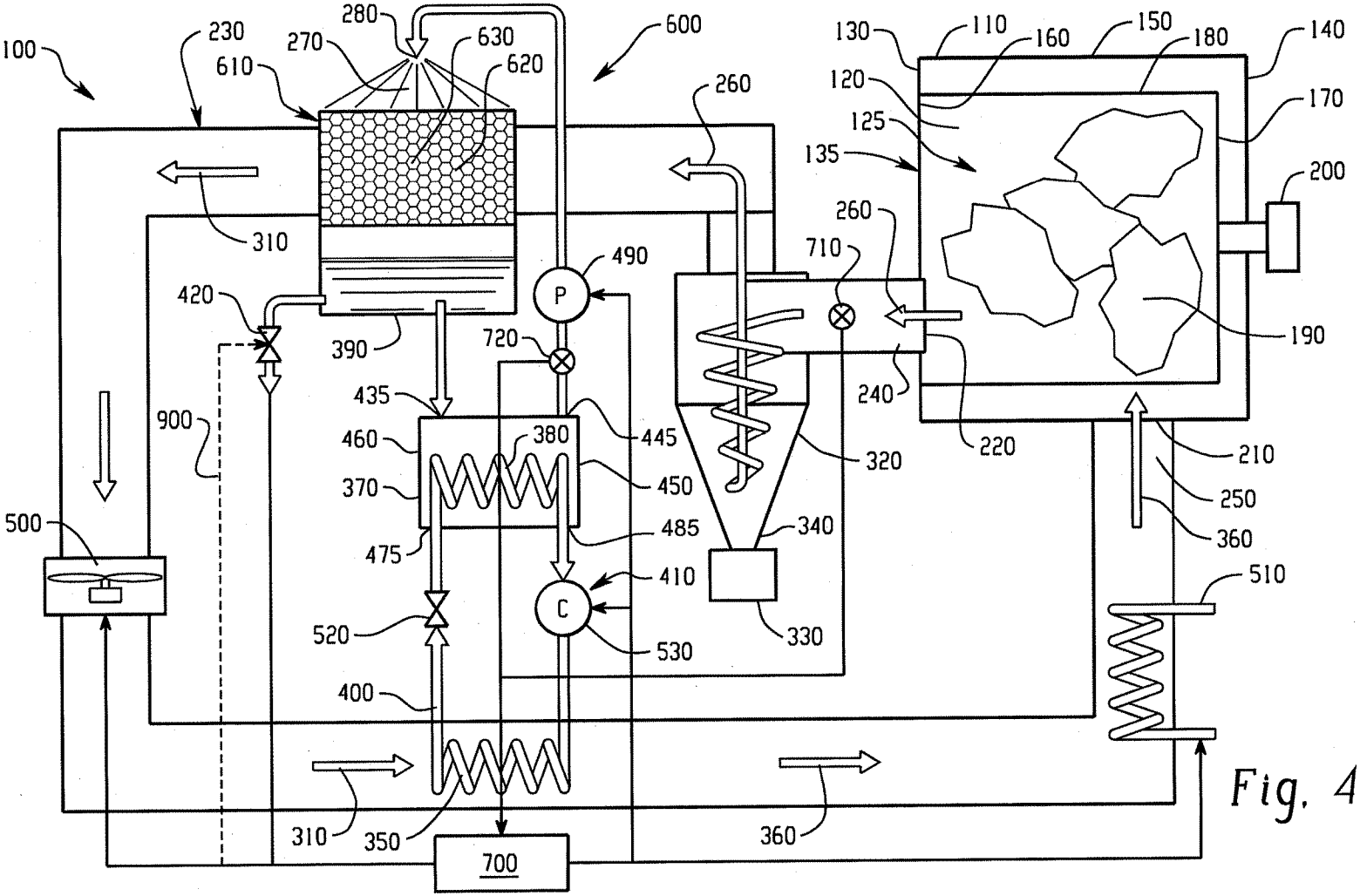
FIG. 4 is a schematic view of the second embodiment of the heat pump dryer with the addition of a controller.
Figure 5:
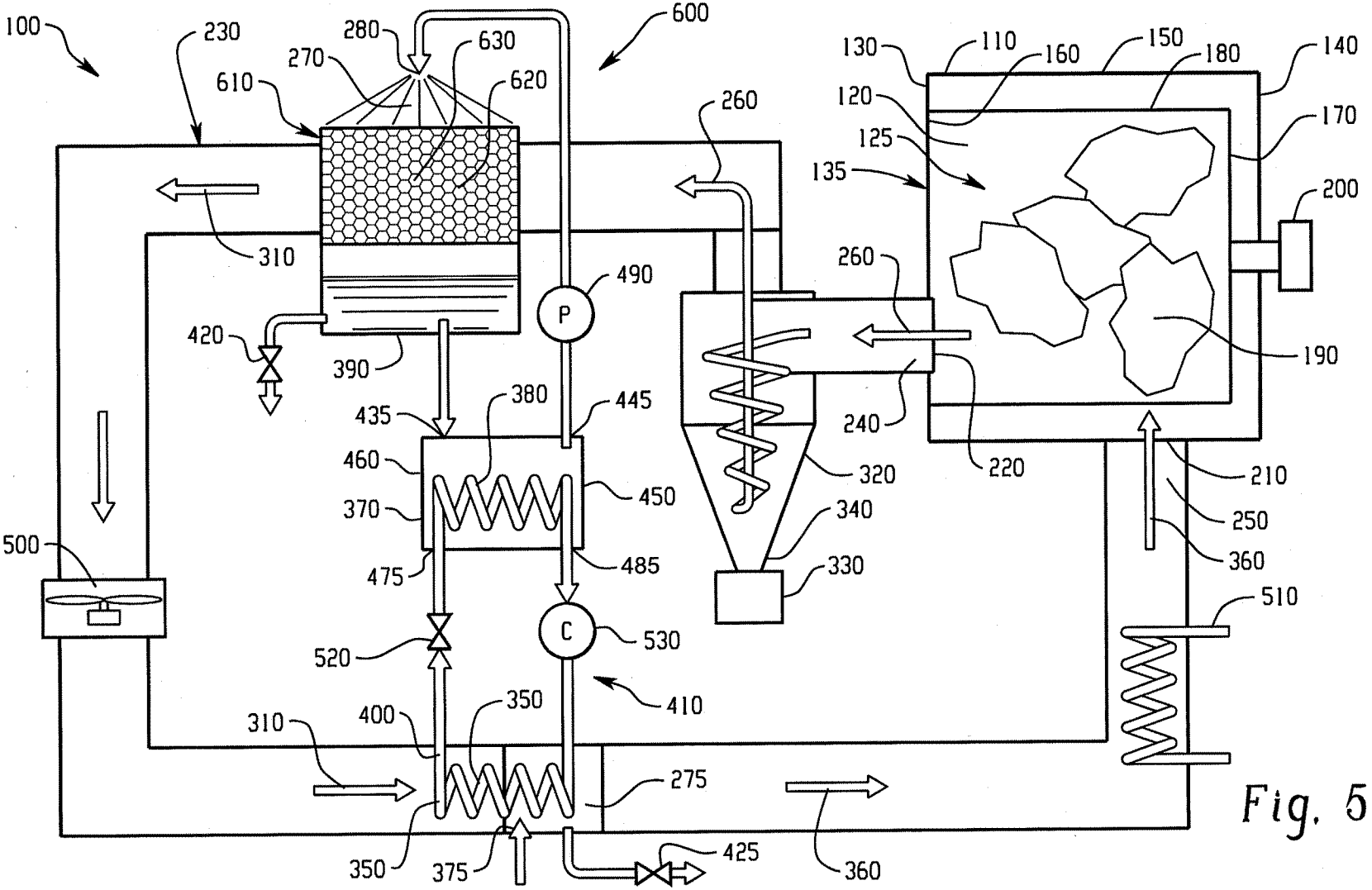
FIG. 5 is a schematic view of the second embodiment of the heat pump dryer.

FIGS. 3-5 show another embodiment of the heat pump dryer 100 that uses a second circulating fluid cycle 600 by which the fluid 270 of decreased temperature enters the pathway 230 along a collector 610 comprising an evaporative exchange media 620. The evaporative exchange media 620 may have a honeycomb shape media extended throughout a portion of the pathway 230 and operatively oriented to receive the fluid 270 thereby creating a wet surface 630 therein. The fluid 270 may be provided to the evaporative exchange media 620 through a spray nozzle 280 to comprehensively cover the media or the fluid may be drizzled thereon allowing the fluid 270 to soak or wick through the media 620. Hot humid air 260 exits the outlet 220 and passes through a lint separator 330 prior to interacting with the wet surface 630 of the evaporative exchange media 620. The evaporative exchange media 620 may comprise a desiccant material or other type material such as GLASdek® material supplied by Munters Corp. The lint separator 330 may comprise a generally cyclone shaped body 320 for lint collection at the base 340 or a conventional mesh filter accessible by an associated user.

The interaction at the evaporative exchange media 620 creates heat and mass transfer between the fluid 270 of a decreased temperature and the hot humid air 260 by which moisture or condensate is extracted from the air 260. The hot humid air 260 passes the wet surface 630 and is modified to become a cold dry air 310 while the fluid 270 now has an increased temperature. The fluid 270 and condensation is then combined in the collector 610 to be circulated through the circulating fluid cycle 600 of the dryer 100.

In each embodiment, the cool dry air 310 leaves the collector 290, 610 and interacts with a heat source 350 or condenser that is at least partially located within the pathway 230. The heat source 350 is part of a heat pump or heat pump device 410 that is generally known in the art. The heat source 350 may comprise a coil or tube arrangement having heat transfer fins or other geometrical shapes to comprehensively interact with the cool dry air 310. A refrigerant 400 is circulated through the heat pump 410. The heat pump 410 also includes a heat sink 380 or evaporator, spaced from the pathway 230, that is operatively associated with the heat source 350 located at least partially within the pathway 230. Additionally, the heat pump 410 may also comprise an expansion valve 520 and a compressor 530 separately attached between the heat source 350 and the heat sink 380. The expansion valve 520 is positioned to receive refrigerant 400 from the heat source 350 to be transferred to the heat sink 380. The compressor 530 is positioned to receive refrigerant from the heat sink 380 to be transferred to the heat source 530. Heat pumps are commonly known in the art and operate to manipulate the temperature and pressure of a refrigerant circulated therein to transfer heat between a heat sink and a heat source.

As the cool dry air 310 interacts with the heat source 350, heat and mass transfer occurs and increases the temperature of the cool dry air 310 and decreases the temperature of the refrigerant 400 within the heat source 350. The cool dry air 310 then becomes hot dry air 360 at this point in the drying cycle. Notably, the collector 290 and lint separator 330 arrangements upstream of the heat source 350 help to prevent the buildup of unwanted lint and airborne particles along a body of the heat source 350. Buildup of lint above the surface of the heat source may substantially affect the heat transfer efficiency and overall balance of the dryer 100.

The hot dry air 360 continues through the pathway and enters the inlet 210 to interact with the associated articles 190 to be dried. A fan 500 may be introduced to the pathway 230 to transfer air from the outlet 220 to the inlet 210 of the pathway 230. The fan 500 is preferably located along the pathway 230 at a position downstream of the collector 290, 610 and upstream of the inlet 210 to allow for the proper transfer of air through the pathway 230. An auxiliary heat source 510 may also be provided downstream of the heat source 350, upstream of the inlet 210, and within the pathway 230 for additional heat transfer to the hot dry air 360 as necessary for drying the associated articles 190.

The fluid 270 received by the collector 290 is in communication with an enclosure 370 that at least partially contains the heat sink 380. The fluid 270 may first be provided to a tank 390 for storage or to add or dispense fluid 270 within the circulating fluid cycles 300, 600. The tank 390 may be provided with at least one drain valve 420 attached to an associated drain or an associated water source. The enclosure 370 may be arranged as a heat exchanger to transfer heat between the refrigerant 400 within the heat sink 380 and the fluid 270. In the embodiments depicted in FIGS. 1-2, the enclosure 370 comprises a cross-direction heat exchanger whereby the fluid 270 and refrigerant 400 remain separated within the enclosure while they exchange heat. The fluid 270 of an increased temperature enters at a first port 430 adjacent a first end 450 of the enclosure 370 to interact with the heat sink 380 and exits at a second port 440 adjacent a second end 460 of the enclosure 370. The fluid 270 exits the second port 440 having a decreased temperature as it transfers heat to the refrigerant 400 within the enclosure 370. The direction of flow of the fluid 270 is opposite to the flow of the refrigerant 400 within the heat sink 380. The refrigerant 400 of a decreased temperature enters at a third port 470 adjacent the second end 460 of the enclosure 370 to interact with the fluid 270 and exits at a fourth port 480 adjacent the first end 450 of the enclosure 370. The refrigerant 400 exits the fourth port 480 having an increased temperature as heat is transferred from the fluid 270 to the refrigerant 400 within the enclosure 370.

The enclosure 370 of each embodiment depicted in FIGS. 3-5 comprises a common direction heat exchanger. Here, the fluid 270 of an increased temperature enters at a first port 435 adjacent the second end 460 of the enclosure 370 to interact with the heat sink 380 and exits at a second port 445 adjacent the first end 450 of the enclosure 370. The fluid 270 exits the second port 445 having a decreased temperature as the fluid transfers heat to the refrigerant 400 within the enclosure 370. The direction of flow of the fluid 270 is generally parallel to the flow of the refrigerant 400 within the heat sink 380. The refrigerant 400 of a decreased temperature enters at a third port 475 adjacent the second end 460 of the enclosure 370 to interact with the fluid 270 and exits at a fourth port 485 adjacent the first end 450 of the enclosure 370. The refrigerant 400 exits the fourth port 485 having an increased temperature as heat is transferred from the fluid 270 to the refrigerant 400 within the enclosure 370.

The fluid 270 is circulated through the circulating fluid cycles 300, 600 by a pump 490 that is operatively attached to the enclosure 370 and the pathway 230. The pump 490 of FIG. 1-5 is preferably located downstream of the enclosure 370 and upstream of the spray nozzle 280 by which the fluid 270 leaves the enclosure 370 with a decreased temperature and re-enters the pathway 230 to interact with the hot humid air 260 exiting the cavity 125 of the drum 120. The pump 490 may also be located upstream of the collectors 290, 610 or downstream of the tank 390 and/or enclosure 370 to introduce the required transfer pressure necessary to circulate the fluid 270 through the circulating fluid cycles 300, 600.

As schematically shown in FIGS. 2 and 4, a controller 700 is provided in communication with a series of controllable components and sensors within the dryer 100. In one embodiment, a first sensor 710 is provided along the pathway 230 adjacent the outlet 220 to indicate at least one variable output value of a temperature and a relative humidity of the hot humid air 260 as the air is exhausted from the outlet 220. A second sensor 720 is provided at circulating fluid cycles 300, 600 to measure a variable output value of a temperature of the fluid 270 as the fluid exits the second ports 440 and 445 from the enclosure 370. The variable outputs measured by the first sensor 710 and second sensor 720 allows the controller 700 to modulate controllable components of the dryer 100 to provide the fluid 270 to the pathway 230 at a temperature below the dew point temperature of the hot humid air 260. As indicated by FIGS. 2 and 4, the controllable components may include the motor 200, the compressor 530, the pump 490, the drain valve 420 and the fan 500. Notably, as the temperature of the hot humid air 260 increases, the dew point temperature of the hot humid air 260 increases. Additionally, as the amount of moisture is reduced from the associated articles 190 or there otherwise exists a reduced load, the dew point of the hot humid air 260 also increases. In one embodiment, the fluid 270 is provided to the pathway 230 to interact with the hot humid air 260 when the temperature of the fluid 270 is at least 2-3 degrees Farenheit lower than the dew point of the hot humid air 260. The fluid temperature is controlled by adaptively operating/balancing the heat pump and/or by using an external heat source/sink. Such an external heat sink could be ambient air or any available water/fluid or rinse water that may be available from the preceding wash cycle for subcooling/superheating. Likewise, the amount of fluid can be managed so that condensate is retained in the system from overflow and/or a heat content perspective. Still another option is to selectively use an auxiliary heat source 510 to occasionally manipulate the dew point from time to time during the whole cycle. This embodiment provides an efficient relationship for heat and mass transfer of the circulating fluid cycles 300, 600 within the dryer 100.

The circulating fluid cycles 300, 600 may be provided to an individual heat pump dryer appliance as well as to a combination washer and dryer appliance. Further, these cycles may be provided without a rotating drum or be provided with a housing having a flat dryer body or a clothing rack. Selected aspects can also be utilized in dry cleaning applications where a number of washes are done with solvents.

In another embodiment of the present disclosure, FIG. 5 depicts a supplemental enclosure 375 located within the pathway 230 and at least partially about the heat source 350. The supplemental enclosure 375 provides heat transfer between the heat source 350 and a supplemental fluid 275 to reduce the amount of heat produced by the heat source 350 and transferred to the cool dry air 310. The supplemental enclosure 375 is typically used when only a small amount of moisture remains within the associated articles 190 to be dried. This reduced load is typically encountered towards the later portion of the drying cycle by which the heat sink 350 produces excess heat resulting in an improper balance of the device 100. The supplemental enclosure 375 and supplemental fluid 275 remove the excess heat from the device 100. The supplemental enclosure is provided with at least one drain valve 425 that is controllable by the controller 700.

Figure 6:
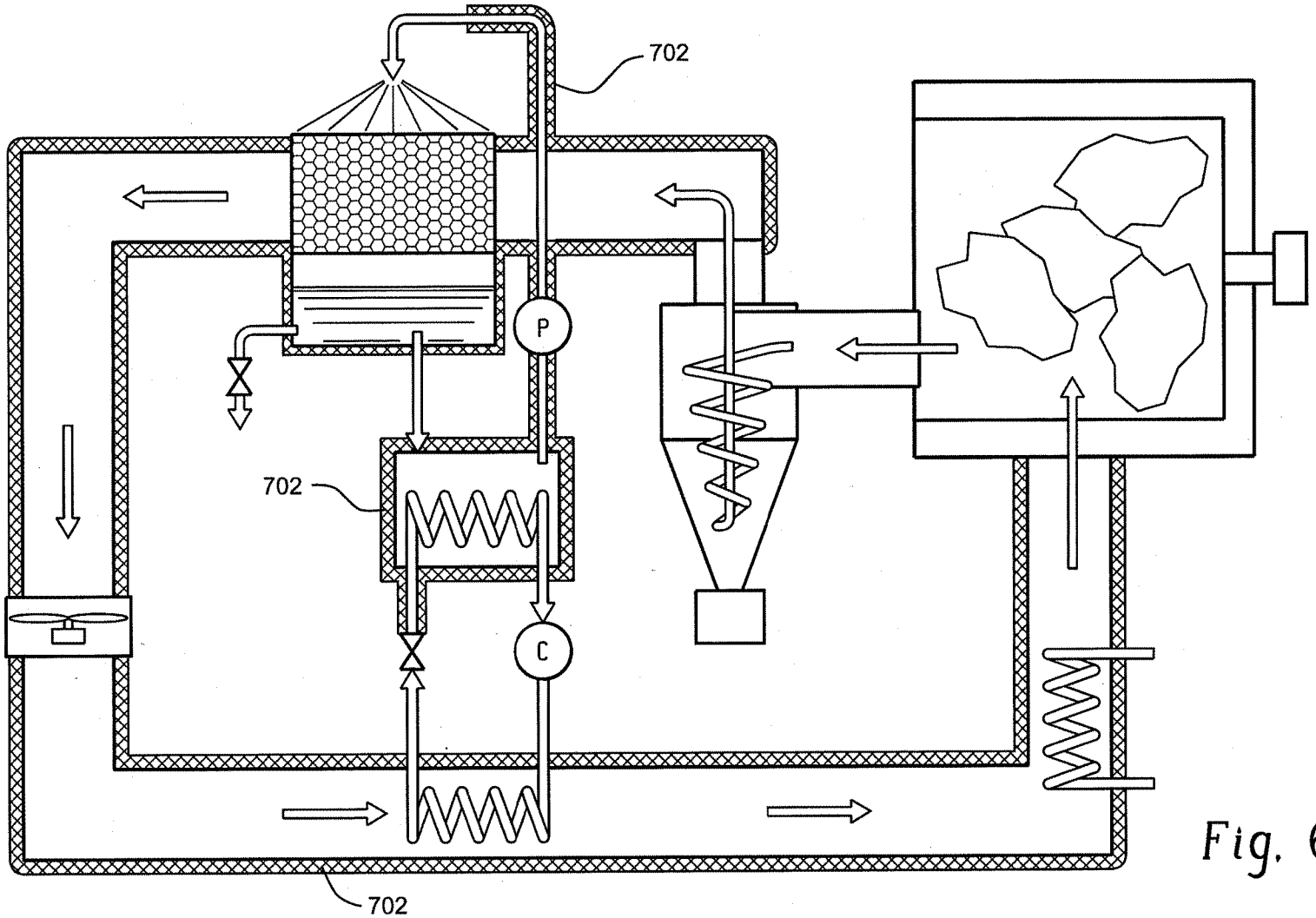
FIGS. 6-9 show alternative embodiments of the heat pump dryer.
Figure 7:
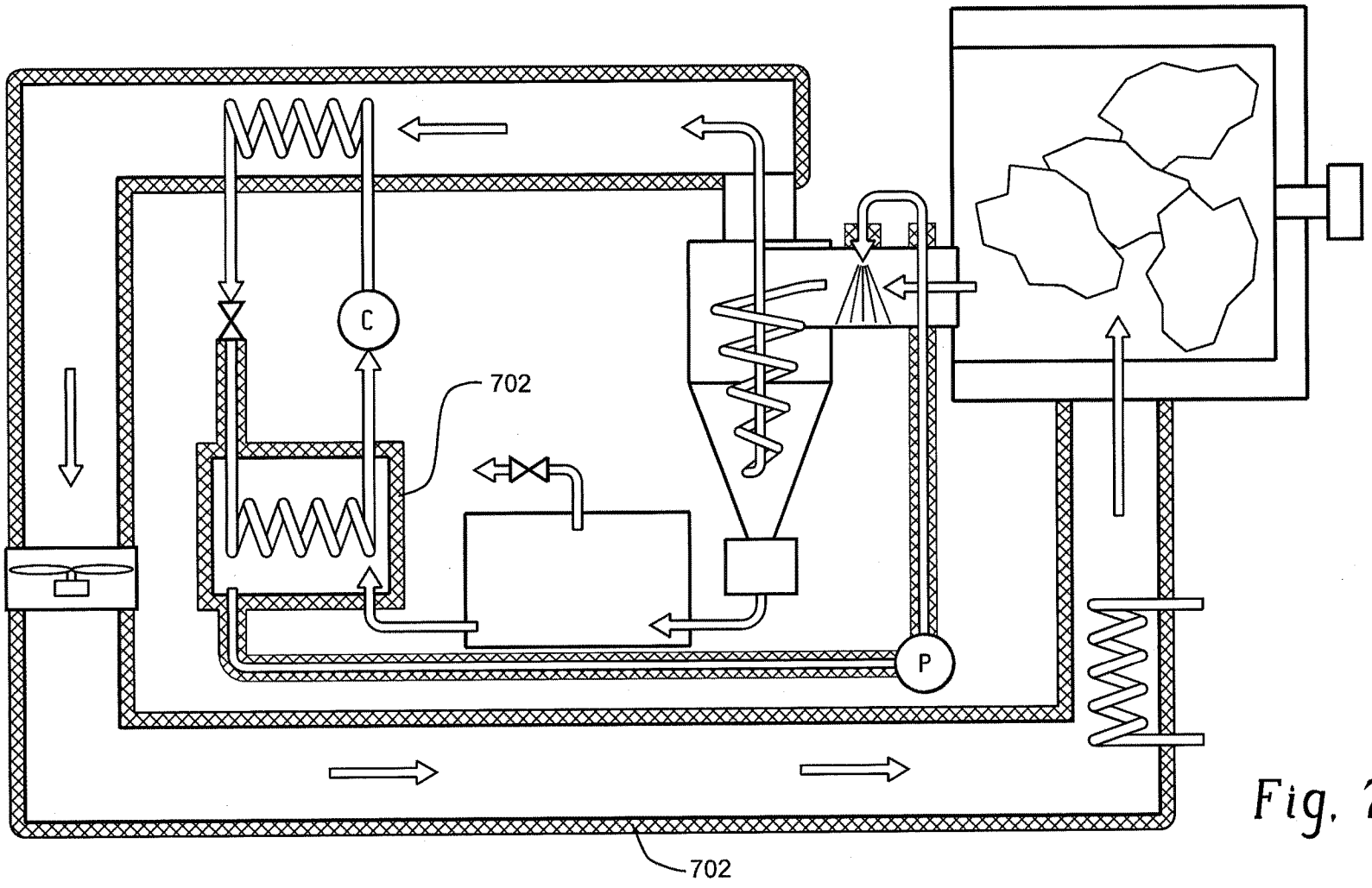
Figure 8:
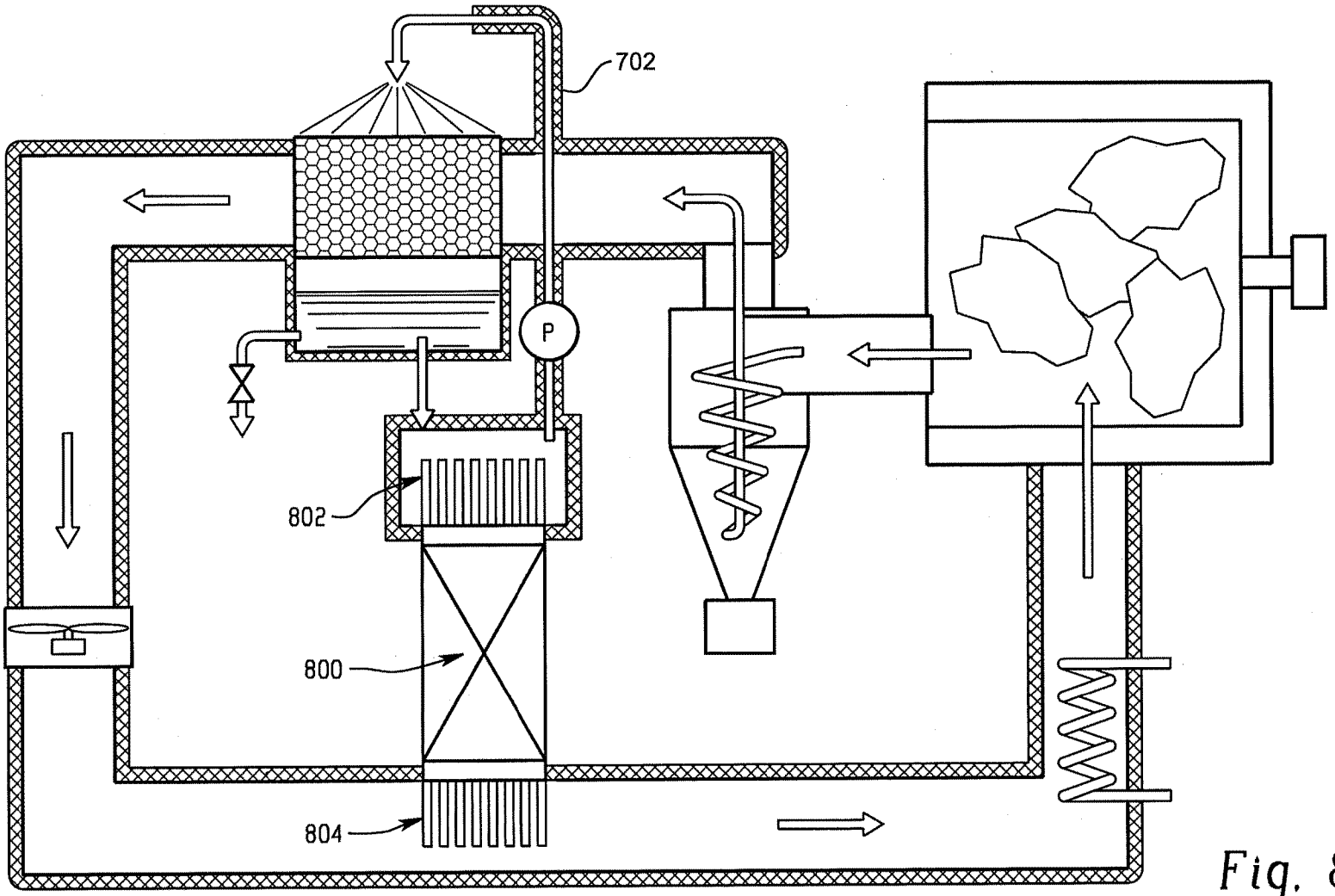
Figure 9:
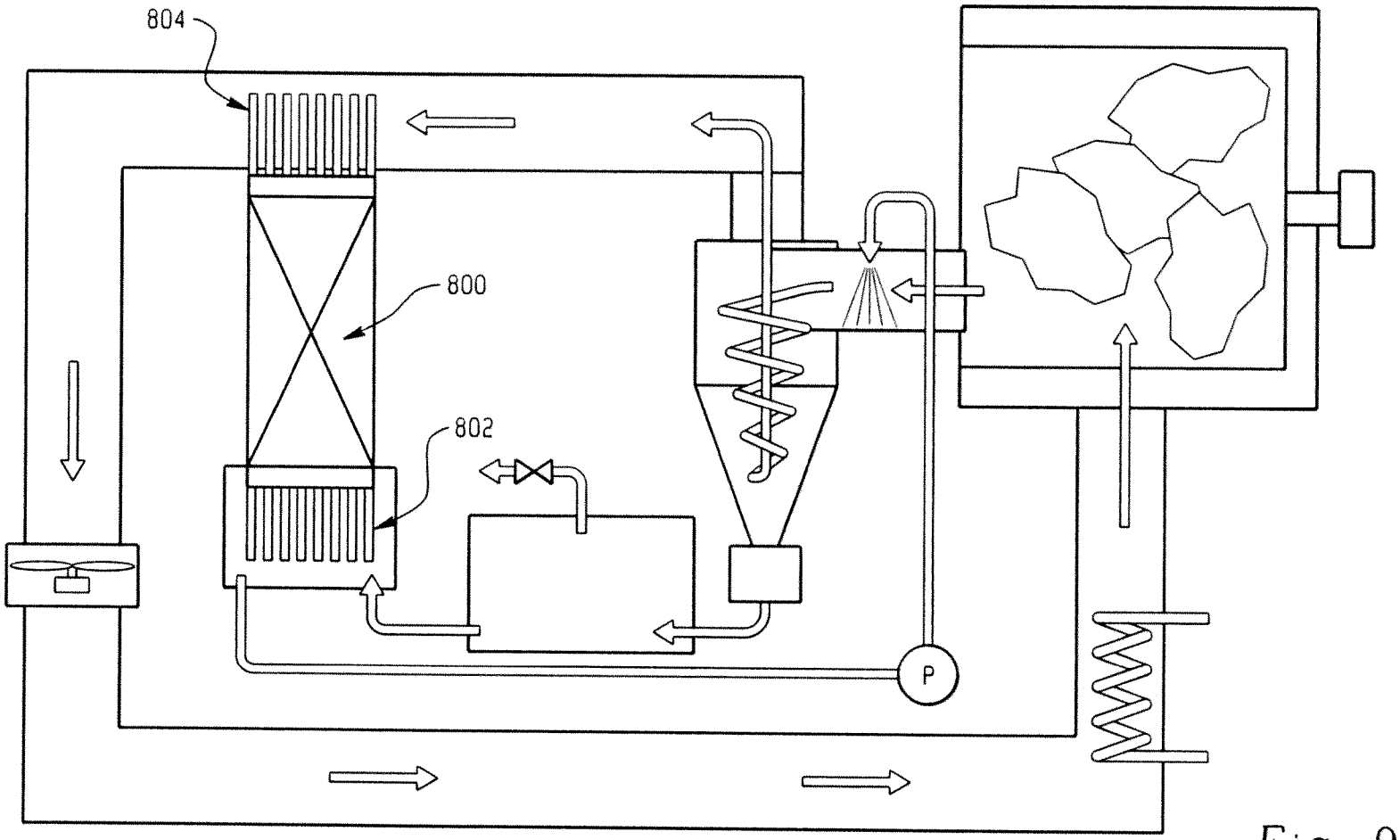

An embodiment of the proposed device may also have a thermal insulation layer 702 applied over at least a partial surface on some of the pathway 230, tank 390, enclosure 370, collector 290 and fluid conduits constituting the fluid cycles 300,600, refrigerant conduits in order to contain undesired heat exchange between any of the fluid 270, cool dry air 310, hot dry air 360, hot humid air 260, refrigerant 400 and the corresponding adjacent ambient air (FIGS. 6-8). In other embodiments (FIGS. 8 and 9), the heat pump device 800 is one of a thermoelectric device, thermoacoustic device and a magnetocaloric device, and the heat sink 380 and heat source 350 are cold side heat exchanger 802 and hot side heat exchanger 804, respectively (FIG. 8). Further the heat pump device is configured to manipulate the temperatures of the cold side heat exchanger and hot side heat exchanger. Further the cold side heat exchanger 802 cools the circulating fluid that is subsequently used to cool and dehumidify the dryer air while the hot side heat exchanger 804 is used to reheat the cooled and dehumidified dryer air. In these embodiments too, a temperature or relative humidity sensor coupled with a suitable controller will be used to manipulate the temperatures of the cold side heat exchanger and hotside heat exchanger, as well as used to control the operation of various components such as pumps, valves, fans and the heat pump.

Thus, this disclosure relates to a heat pump system for drying clothes wherein an evaporator exchanges heat with a circulating fluid, which is subsequently used as a condensation means for removal of moisture or condensate from a moist dryer exhaust air, and using the enthalpy of the moist air to minimize energy requirements.

An evaporator cools the circulating fluid during a drying cycle and acts as a continuous source of low temperature fluid whereas the fluid temperature is lower than the dew point temperature of the moist dryer exhaust air. The fluid is then used in a heat and mass exchange process with the moist air such that the air is dehumidified due to condensation of airborne moisture. The circulating fluid carries the condensate to exchange heat with the evaporator. The heat of evaporation of the fluid is continuously reused for drying clothes in a heat pump based dryer.

In one embodiment, the circulating fluid of a reduced temperature is sprayed into the moist dryer exhaust air using a suitable spray nozzle to effect heat and mass exchange therein. A spray droplet separator and lint separator then removes the circulating fluid, condensate water and lint from the dryer air.

In another embodiment, a heat and mass exchange media may be used in such a way that the circulating fluid of a reduced temperature is gravitated through a honeycomb structured wicking media. The moist dryer exhaust air flows over a wetted surface of the wicking media to cause mass and heat exchange. Here, a separate lint collector such as a mesh filter or cyclone may be used upstream of the exchange media.

Each embodiment of the proposed device includes a heat pump with a heat exchanger acting as an evaporator wherein the refrigerant is circulated on one side of a heat exchanger wall and the circulating fluid is circulated on the other side. Further, the device may include at least one reservoir or tank and a controllable circulating pump to store and handle the required amount of circulating fluid. These components are controlled to maintain the desired temperatures of the fluid and air thereby facilitating an efficient and balanced performance.

Figure 10:
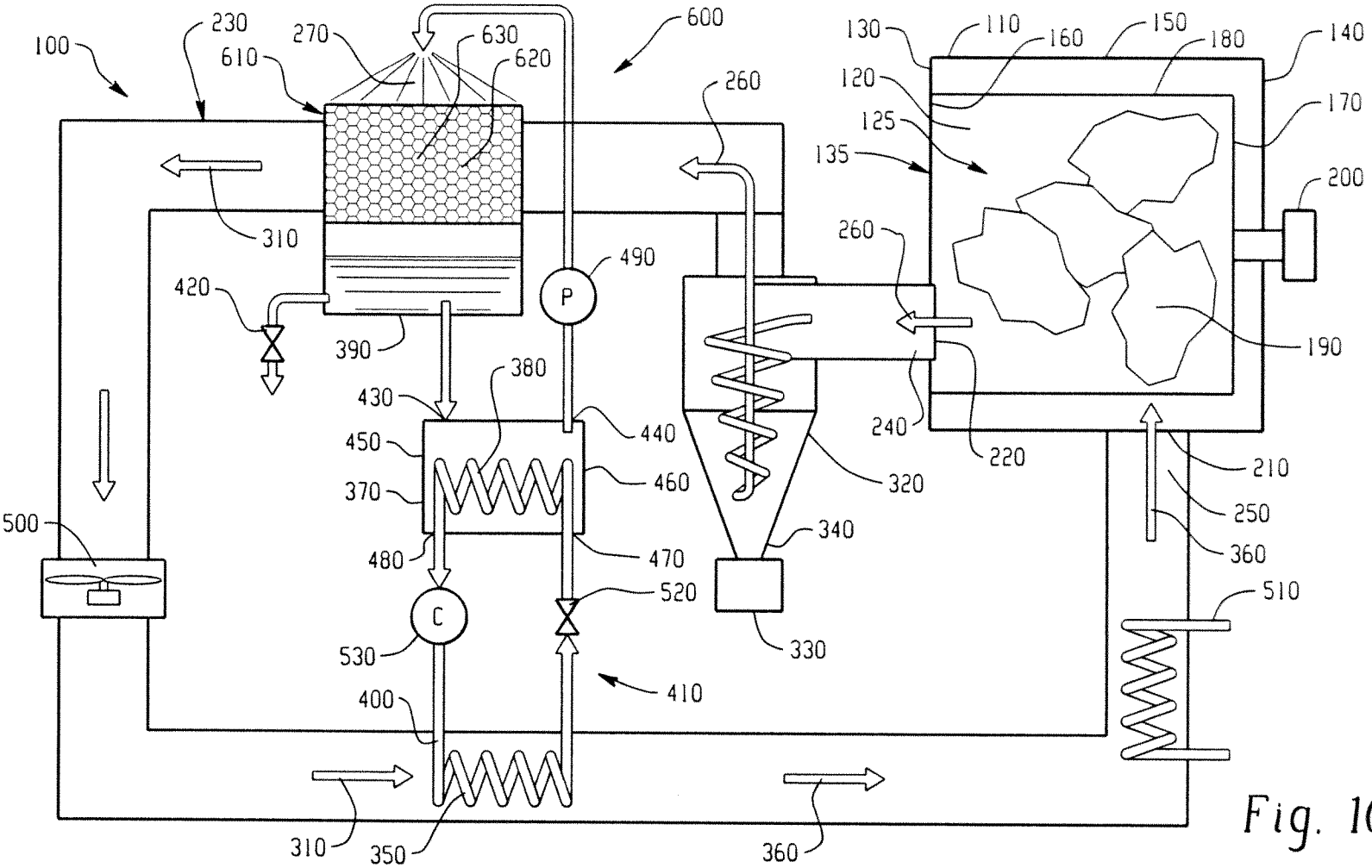
FIGS. 10-14 illustrate minor modifications to selected embodiments.
Figure 11:
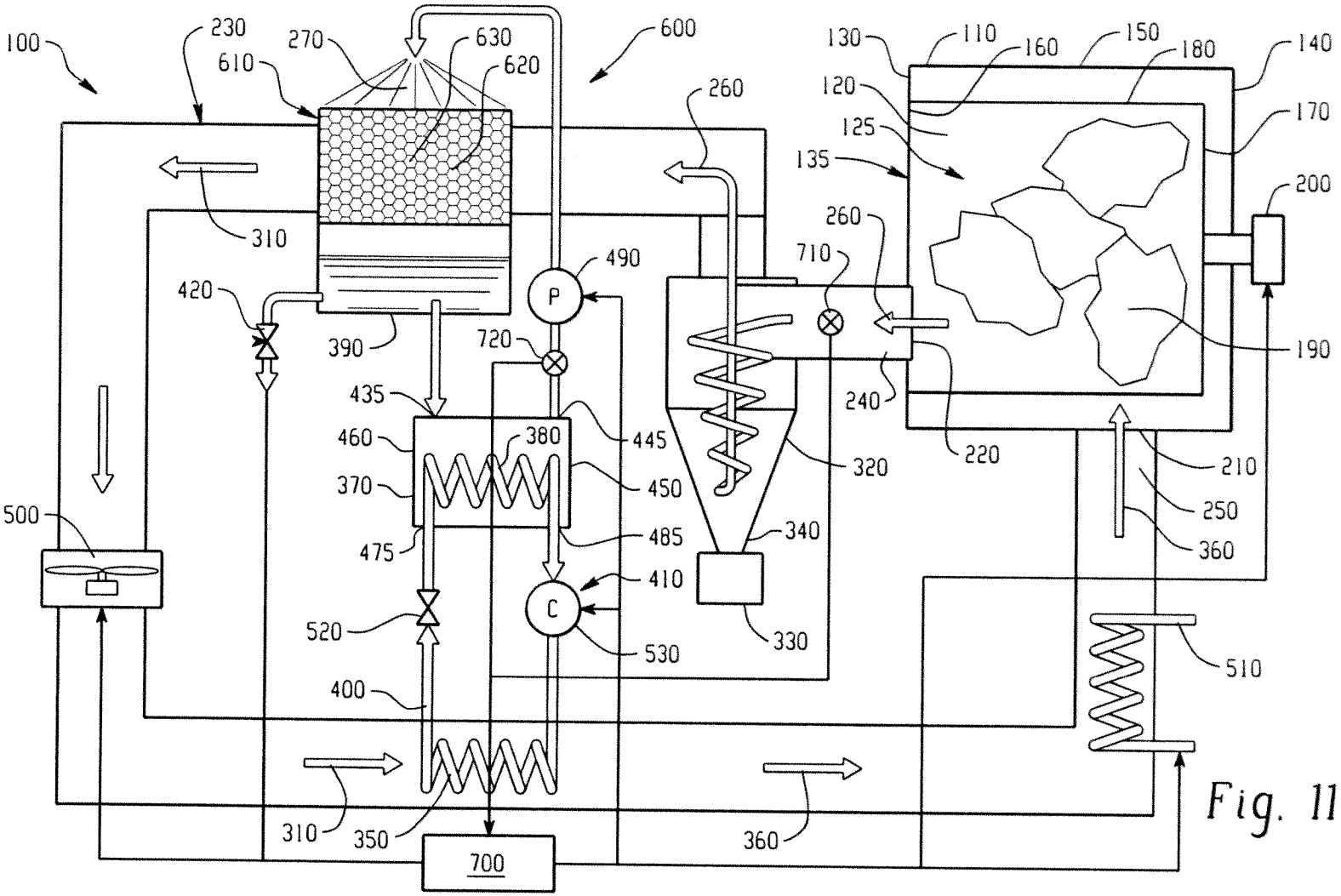
Figure 12:
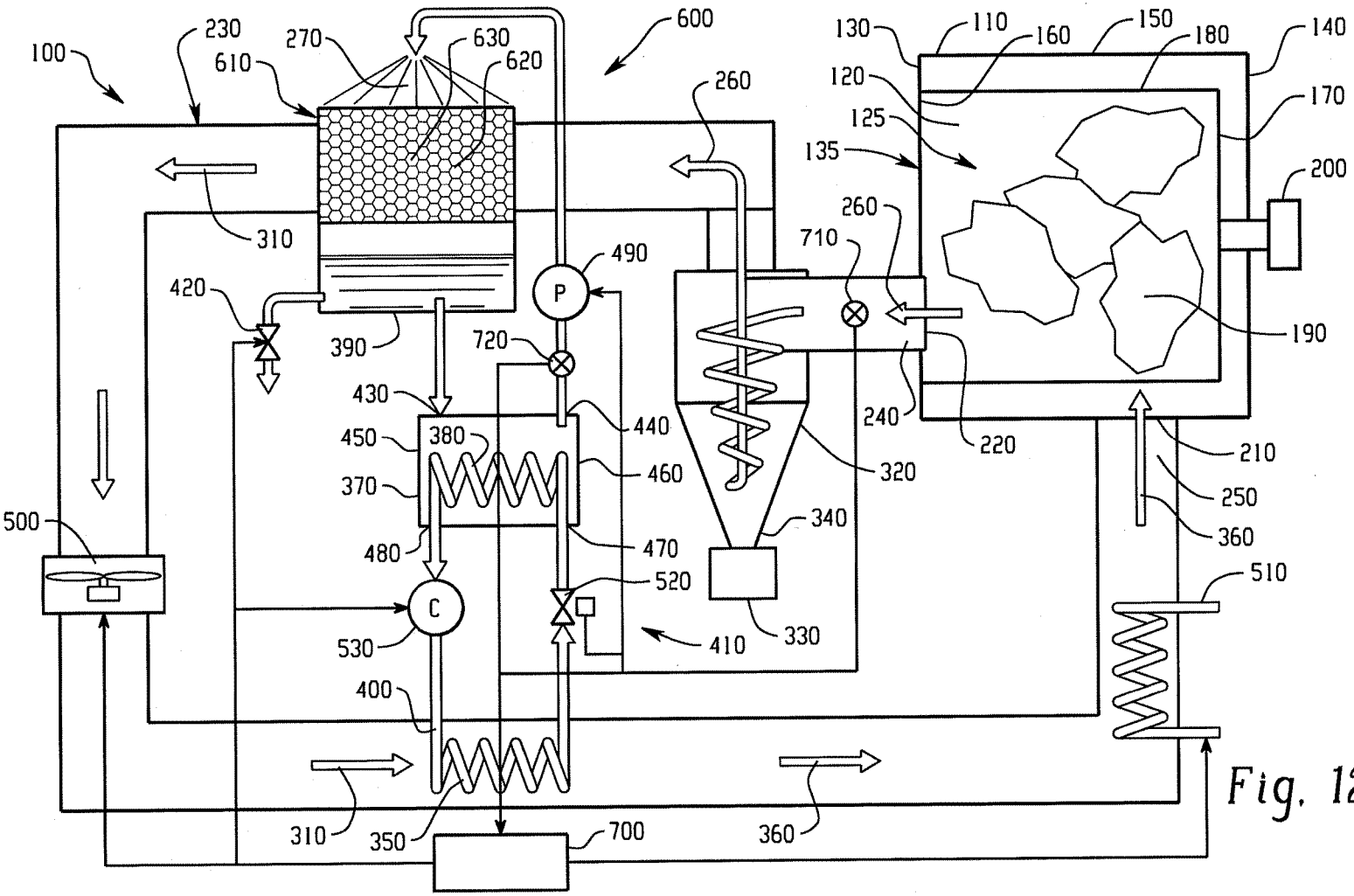
Figure 13:
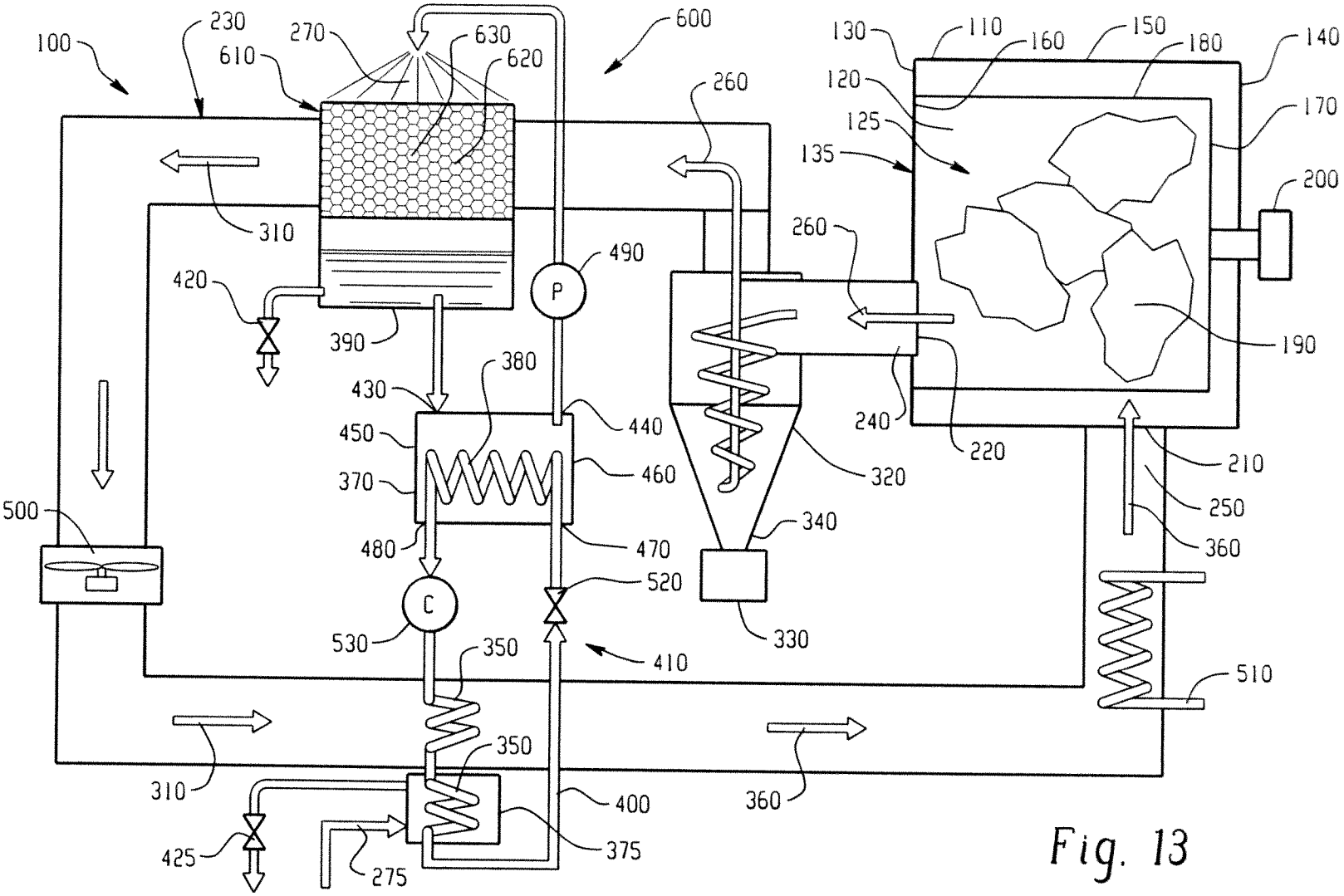
Figure 14:
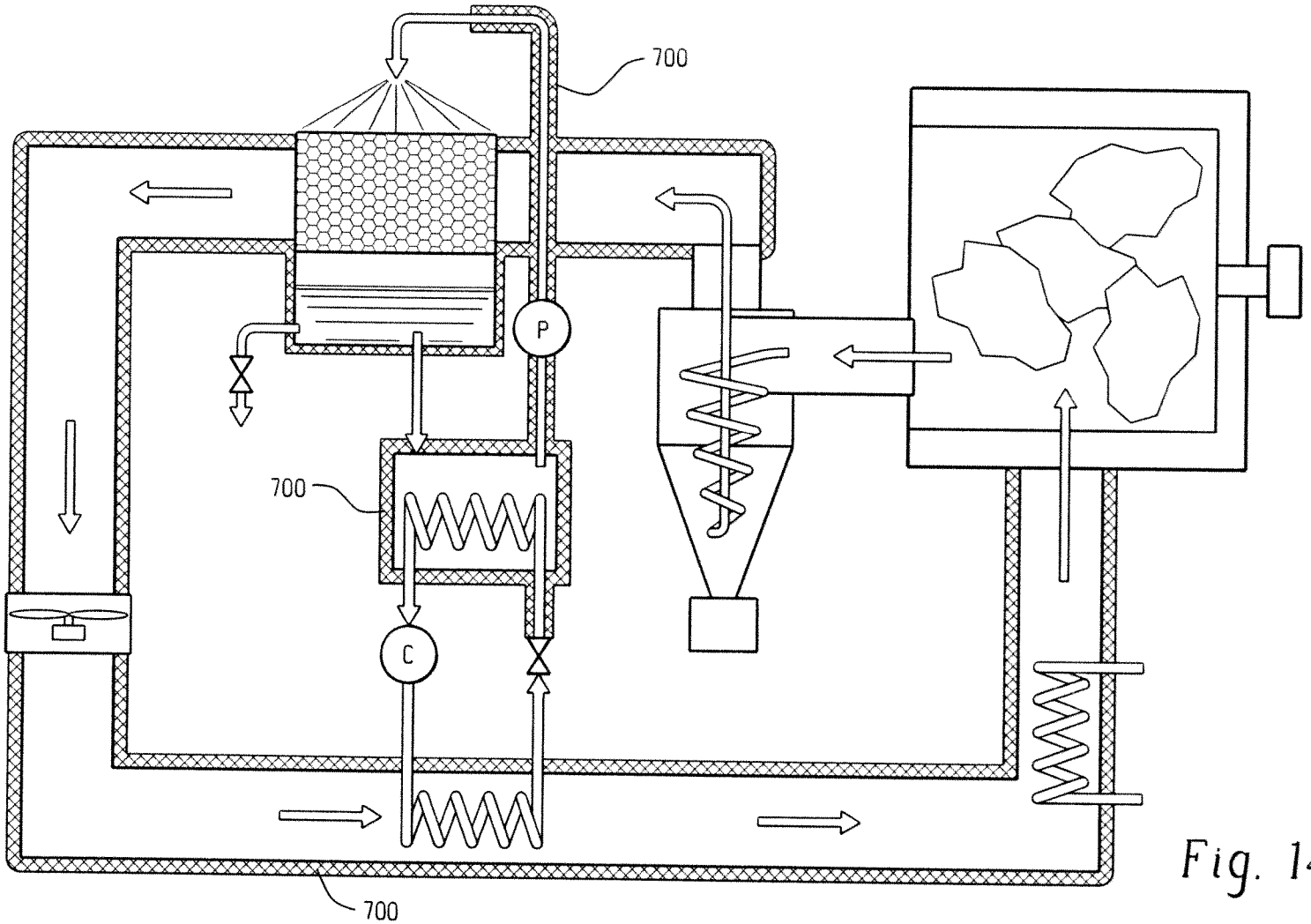

A number of modifications may be made without departing from the scope and intent of the present disclosure. For example, portions of heat sink 380 and/or heat source 350 may be placed external to the enclosure and pathway 230, respectively, to facilitate superheating/subcooling internally or with external sources. Alternatively in FIG. 10, flow through the heat sink may be in the counter-direction as opposed to the parallel direction shown in FIG. 3. Another change may include line 900 (shown in broken line in FIG. 11) that extends from the controller 700 to drain valve 420 (otherwise similar to FIG. 4) to control or maintain the fluid temperature below the dew point and to drain the collected condensate. Another change is shown in FIG. 12 where flow through the heat sink is in the counter-direction when compared to FIG. 4 and an additional connection is provided between compressor 530 and the controller 700. In FIG. 13, modifications to the embodiment of FIG. 5 are illustrated to show an auxiliary condenser exchanging heat with an external fluid source (subcooling), whereas in FIG. 14, a modification to the FIG. 6 embodiment provides flow in the counter-direction through the heat sink.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. A heat pump based dryer device comprising:

a housing receiving a drum for containing associated articles to be dried by air that flows along a pathway between an outlet and an inlet of the housing;

a heat pump located at least partially within the pathway;

a spray nozzle operatively attached to the pathway at a position between the outlet and the heat pump, the spray nozzle being configured to provide a fluid to the air in the pathway and at least partially remove moisture from the air; and a collector within the pathway downstream from the spray nozzle between the spray nozzle and the heat pump to collect at least a portion of the fluid and at least a portion of the condensation within the pathway;

wherein the heat pump includes:

a heat source located at least partially within the pathway, wherein the heat source is a condenser, a heat sink spaced from the pathway such that the air along the pathway is in fluid isolation from the heat sink, the heat sink being operatively adapted to the heat source, wherein the heat sink is an evaporator, and an enclosure containing the heat sink and being arranged to accept the fluid from the pathway to exchange heat with the heat sink and return the fluid to the spray nozzle, wherein the heat source is positioned outside of the enclosure away from the heat sink;

wherein the fluid collected by the collector is provided to a tank, at least a portion of the fluid is transferred to the enclosure, the tank having at least one drain valve.

2. The device of claim 1, wherein a pump is provided to transport fluid to the pathway.

3. The device of claim 1, wherein the collector comprises a cyclone shaped body adapted to receive the air and having a lint separator to separate lint from the air and providing the moisture removed from the air to the tank.

4. The device of claim 1, wherein a supplemental enclosure is located within the pathway and at least partially about the heat source and a supplemental fluid is provided within the supplemental enclosure to transfer an excess heat from the heat source.

5. The device of claim 1, wherein an air heater is provided upstream of the heat source, the air heater is controllable by a controller.

6. The device of claim 1 further comprising a thermal insulation layer at least partially covering the pathway and the heat pump.

7. The device of claim 1, wherein the collector comprises an evaporative exchange media having a plurality of perforations, the fluid is provided on the evaporative exchange media creating a wet surface, the air passes over the wet surface that separates the moisture from the air by which the fluid and moisture is provided to the tank.

8. The device of claim 7, wherein a lint separator is provided upstream of the heat source.

9. The device of claim 1, wherein the heat pump further comprises an expansion valve and a compressor positioned in communication between the condenser and the evaporator whereby the expansion valve and compressor further manipulate the pressure and temperature of a refrigerant.

10. The device of claim 9, wherein a fan is adapted to the pathway to circulate the air between the outlet and the inlet.

11. The device of claim 10, further comprising a controller for controlling the heat pump based dryer device.

12. The device of claim 11, further comprising at least one sensor for measuring at least one variable output, the controller configured to receive and process data representative of sensor readings measured by the sensor for controlling the heat pump based dryer device.

13. The device of claim 12, wherein the controller is configured to manipulate the outputs of at least one of the fan, the compressor, a pump and the drain valve.

14. The device of claim 12, wherein the controller selectively maintains a temperature of the fluid to be below a dew point of the air at the outlet of the housing.

15. The device of claim 14, wherein the sensors are adapted to identify at least one of a temperature of the fluid as it leaves the enclosure, a temperature of the air adjacent to the outlet and a relative humidity of the air adjacent to the outlet.

16. A method of drying articles with a heat pump based dryer device comprising a housing receiving a drum for containing associated articles to be dried and having a condenser adapted to an evaporator for manipulating the temperature and pressure of a refrigerant, the evaporator comprising a return fluid heat exchanger, said method comprising the steps of:

delivering hot dry air to the inlet of the housing;

extracting hot humid air from the outlet of the housing;

adding a fluid to the hot humid air in a pathway through a spray nozzle, the fluid having a temperature lower than the dew point of the hot humid air for dehumidifying the hot humid air within the pathway and creating condensation and cool dry air;

collecting at least a portion of the fluid and at least a portion of the condensation within the pathway downstream from the spray nozzle;

providing the at least a portion of the fluid and condensation to the evaporator return fluid heat exchanger, the evaporator return fluid heat exchanger being spaced from the pathway within an enclosure such that the air along the pathway is in fluid isolation from the evaporator return fluid heat exchanger;

heating the cool dry air with the condenser within the pathway to create the hot dry air, the condenser being positioned outside of the enclosure; and returning the fluid having a temperature lower than the dew point of the hot humid air to the pathway and the hot dry air to the housing.

17. The method of claim 16, wherein the step of adding a fluid to the air further comprises use of an evaporative exchange media having a plurality of perforations, the fluid is first added to the evaporative exchange media creating a wet surface, the air passes over the wet surface that at least partially separates the fluid and condensation from the air.

* * * * *